US008899627B2

(12) United States Patent
Krause et al.

(10) Patent No.: US 8,899,627 B2
(45) Date of Patent: Dec. 2, 2014

(54) MULTIPLE FUEL TANK SYSTEM

(75) Inventors: Paul Krause, Twin Lake, MI (US); Jason Fu, Spring Lake, MI (US); John Lane, Muskegon, MI (US); Todd Lutz, Oconomowoc, WI (US)

(73) Assignee: Wacker Neuson Production Americas LLC, Menomonce Falls, WI (US)

( * ) Notice: Subject to any disclaimer, the term of this patent is extended or adjusted under 35 U.S.C. 154(b) by 995 days.

(21) Appl. No.: 13/006,018

(22) Filed: Jan. 13, 2011

(65) Prior Publication Data

US 2012/0180778 A1 Jul. 19, 2012

(51) Int. Cl.
*B60P 3/22* (2006.01)
*F23K 5/04* (2006.01)

(52) U.S. Cl.
CPC ..... *F23K 5/04* (2013.01)
USPC ..... 280/839; 280/834; 280/836; 280/838; 34/423; 34/381; 34/90; 110/241; 126/271.1

(58) Field of Classification Search
CPC ..... B60P 3/22; B60P 3/2215; B60P 3/2295; B60P 3/24; B64F 1/364; B60K 15/073; B60K 15/077
USPC ..... 280/839, 834, 836, 838; 34/423, 381, 34/90; 110/241; 126/271.1
See application file for complete search history.

(56) References Cited

U.S. PATENT DOCUMENTS

| | | | | |
|---|---|---|---|---|
| 1,262,013 | A | | 4/1918 | Callon |
| 3,810,489 | A | | 5/1974 | MacManus et al. |
| 3,825,027 | A | | 7/1974 | Henderson |
| 3,844,264 | A | | 10/1974 | Grainger |
| 4,613,060 | A | | 9/1986 | Ulbrich et al. |
| 4,886,087 | A | | 12/1989 | Kitchen |
| 5,020,566 | A | | 6/1991 | Shoop |
| 5,163,466 | A | | 11/1992 | Moody |
| 5,201,298 | A | | 4/1993 | Shearn |
| 5,360,034 | A | * | 11/1994 | Der Manuelian ..... 137/571 |
| 5,636,654 | A | | 6/1997 | Helm |
| 5,838,880 | A | | 11/1998 | Brooks, Jr. et al. |
| 6,371,151 | B1 | | 4/2002 | Saylor |
| 6,789,568 | B1 | | 9/2004 | Bunnell et al. |
| 7,055,543 | B2 | | 6/2006 | Erickson et al. |
| 7,168,415 | B2 | | 1/2007 | Studebaker et al. |
| 7,380,565 | B2 | | 6/2008 | Eichler |
| 7,591,277 | B2 | | 9/2009 | Johnson et al. |
| 8,281,499 | B2 | * | 10/2012 | Friesen et al. ..... 34/92 |
| 8,296,968 | B2 | * | 10/2012 | Hensley ..... 34/381 |
| 2004/0020474 | A1 | | 2/2004 | Pratt et al. |
| 2008/0099079 | A1 | | 5/2008 | Johnson et al. |
| 2009/0320781 | A1 | | 12/2009 | Kwon |

* cited by examiner

*Primary Examiner* — Joseph M Rocca
*Assistant Examiner* — Marlon Arce
(74) *Attorney, Agent, or Firm* — Boyle Fredrickson, S.C.

(57) ABSTRACT

The present disclosure is directed to a mobile machine, such as hydronic surface heater designed to be transported to a potentially remote worksite and operated for an extended period of time. The machine has a fueled component, such as a burner, fueled by a fuel supply system having at least two fuel tanks that are operably connected to one another by a connection line having an electronically controlled valve therein. The valve is coupled to the machine's electrical system, such as being coupled to the output of the machine's main breaker, so as to be opened whenever the machine is operating but to be otherwise closed. The fuel supply system thus has, in effect, a single tank when the machine is running and multiple separated tanks when the machine is not running. Fuel spill risks therefore are mitigated without having to sacrifice operating time and without significantly complicating the machine's fuel supply systems or its controls.

3 Claims, 5 Drawing Sheets

MULTIPLE FUEL TANK SYSTEM

BACKGROUND OF THE INVENTION

1. Field of the Invention

The present invention generally relates to a fuel supply system for a mobile machine having a fueled component, and more particularly, relates to a fuel supply system having multiple tanks that are coupled to one another when the machine is operating and which are otherwise decoupled from one another.

2. Discussion of the Related Art

Many machines must be transported to and operated at a potentially remote location. These machines include heaters and dryers for thawing frozen ground or keeping recently poured concrete warm while it cures, electrical generators, light towers for lighting construction sites and other areas lacking electrical power. A mobile fuel supply is needed to operate these machines in the field. Further, many of these machines also must be operated for an extended period of time. The ideal fuel supply must therefore be adequate to run the machine non-stop for many hours or even for days. Several hundred gallons (over a thousand liters) of fuel are therefore desired.

The required fuel typically is stored on a tank mounted on the same trailer or other towed or self propelled mobile carrier as the machine. However, storing such large volumes of fuel in a single tank risks very large fuel spills of a tank leaks or is ruptured. Storing fuel in two or more tanks reduces the risk but usually requires redundancy in supply lines, fittings, valves, etc, increasing the cost of the machine and also increasing the risk of spills due to failure of these redundant fuel transfer devices.

Another method of mitigating the risk of fuel spills is to simply reduce to the tank volume to a smaller size. However, this approach reduces the run time of the powered equipment, and increases operating costs by requiring that the tank be refilled on site more frequently. The manpower and downtime associated with such arrangements further increases costs, and refilling on site increases, rather than decreases, the chance of a spill occurring.

What is needed is an inexpensive and reliable system for transporting a desired quantity of fuel to a location while reducing the maximum volume of fuel that can be spilled in the event of a tank failure.

SUMMARY OF THE INVENTION

According to one aspect of the invention, a multiple fuel supply system is provided for a machine having one or more fueled components. The machine has a first fuel tank and a second fuel tank and a valve disposed in a connecting line or other fluid flow path fluidically connecting the first and second fuel tanks. The valve is an electronically controlled valve coupled to the machine's controls such that it is opened whenever electrical power is being supplied to a selected one, a set, or all of the machine's electrical components. In a preferred configuration, the valve is responsive to opening of a main breaker to interconnect the fuel tanks. Otherwise the valve is closed and the two tanks are fluidically separated from one another. Thus, the system has, in effect, a single tank when the machine is running and multiple separated tanks when the machine is not running. Fuel spill risks therefore are mitigated without having to sacrifice operating time and without significantly complicating the machine's fuel supply systems or its controls.

In another aspect of the invention, the machine is carried on a trailer or other mobile carrier, making the system mobile to provide equipment on a remote site, such as a construction site.

In accordance with yet another aspect of the invention, a method of supplying fuel to a machine is provided that includes automatically connecting two or more fuel tanks of the machine to one another when the machine is operating and otherwise automatically disconnecting the fuel tanks from one another.

These and other aspects, advantages, and features of the invention will become apparent to those skilled in the art from the detailed description and the accompanying drawings. It should be understood, however, that the detailed description and accompanying drawings, while indicating preferred embodiments of the present invention, are given by way of illustration and not of limitation. Many changes and modifications may be made within the scope of the present invention without departing from the spirit thereof. It is hereby disclosed that the invention include all such modifications.

BRIEF DESCRIPTION OF THE DRAWINGS

Preferred exemplary embodiments of the invention are illustrated in the accompanying drawings, in which like reference numerals represent like parts throughout, and in which.

DETAILED DESCRIPTION OF THE PREFERRED EMBODIMENTS

Figure 1:
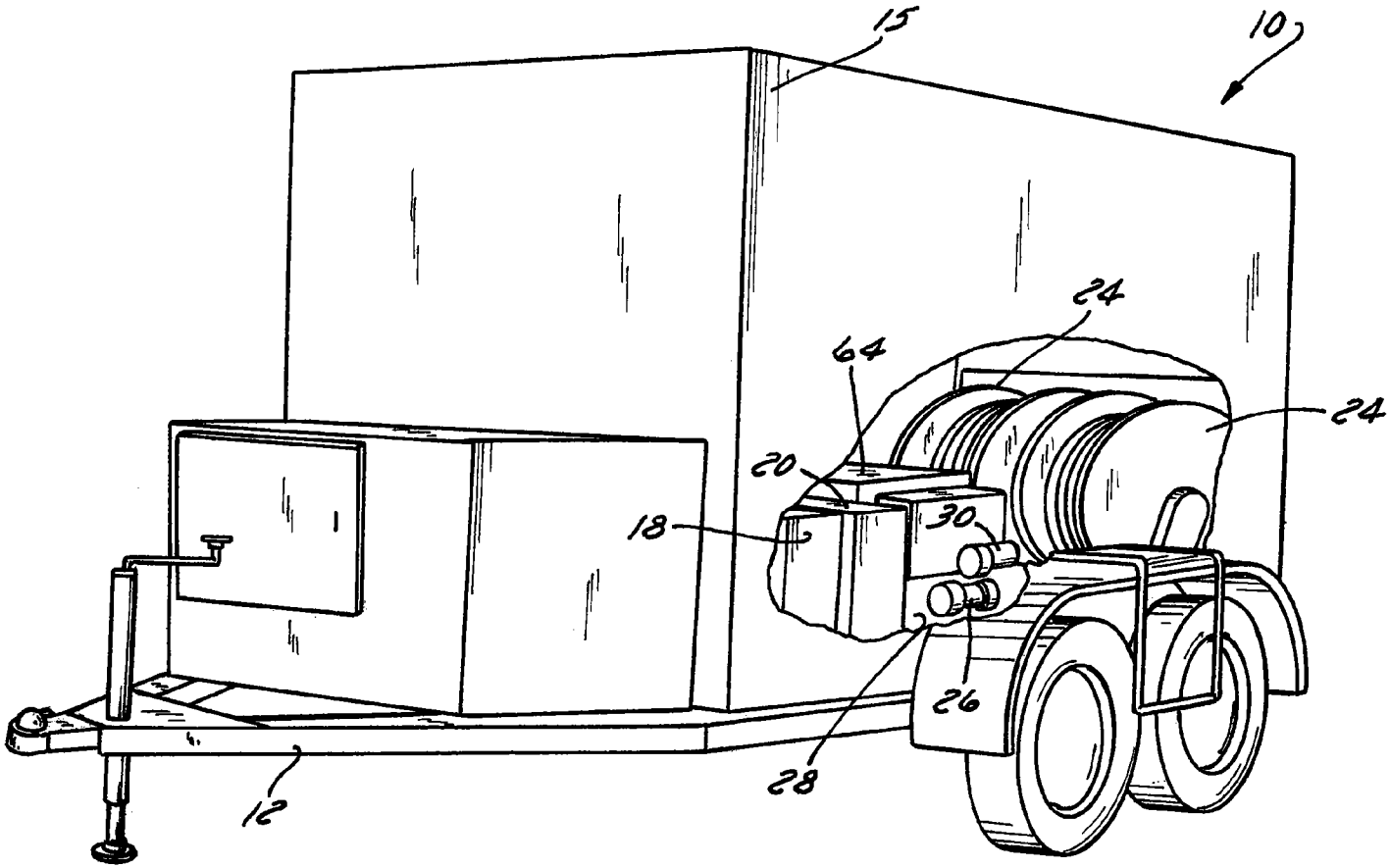
FIG. 1 is a front perspective view of an embodiment of the present invention in the form of a trailer supported hydronic surface heater with a portion of the trailer wall removed to expose portions of the trailer's interior.
Figure 2:
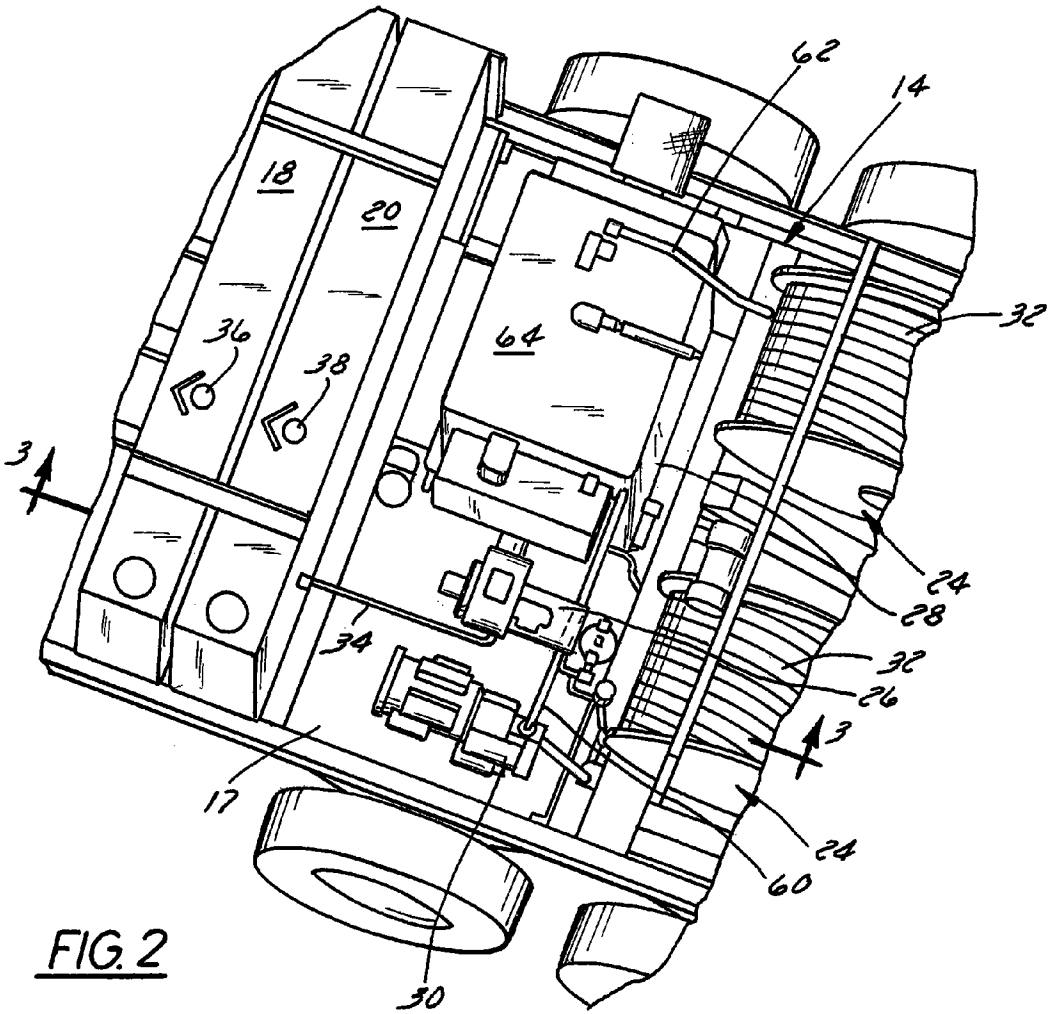
FIG. 2 is a top plan view of the trailer interior shown in FIG. 1, taken from a cutaway view of the top of the trailer.

With reference to the drawing figures, in FIGS. 1 and 2, a body or trailer 10 having a suitable connecting member 12 thereon, such as a trailer hitch, is shown. Trailer 10 is used to carry a machine for use in a remote location. The machine could comprise, for example, a light tower or a mobile generator. In the illustrated embodiment, the machine comprises a hydronic surface heater 14. The surface heater 14 is encased in a housing 15 for enhanced environmental protection and security.

The surface heater 14 comprises a fuel supply system 16 having a first fuel tank 18 and a second fuel tank 20. The surface heater 14 additionally comprises a heater assembly 22 and reels 24. Heater assembly 22 includes a heating element or burner 26 forming a fueled component of the surface heater 14, a tank 28 that stores a fluid heated by the heater, and a pump 30 that is connected to hoses 32 wound on reels 24 as discussed in more detail below. The fluid may, for example, be an ethylene glycol solution. One or both of the fuel tanks 18 and 20 is connected to the heater assembly 22 by way of a supply line 34.

Figure 3:
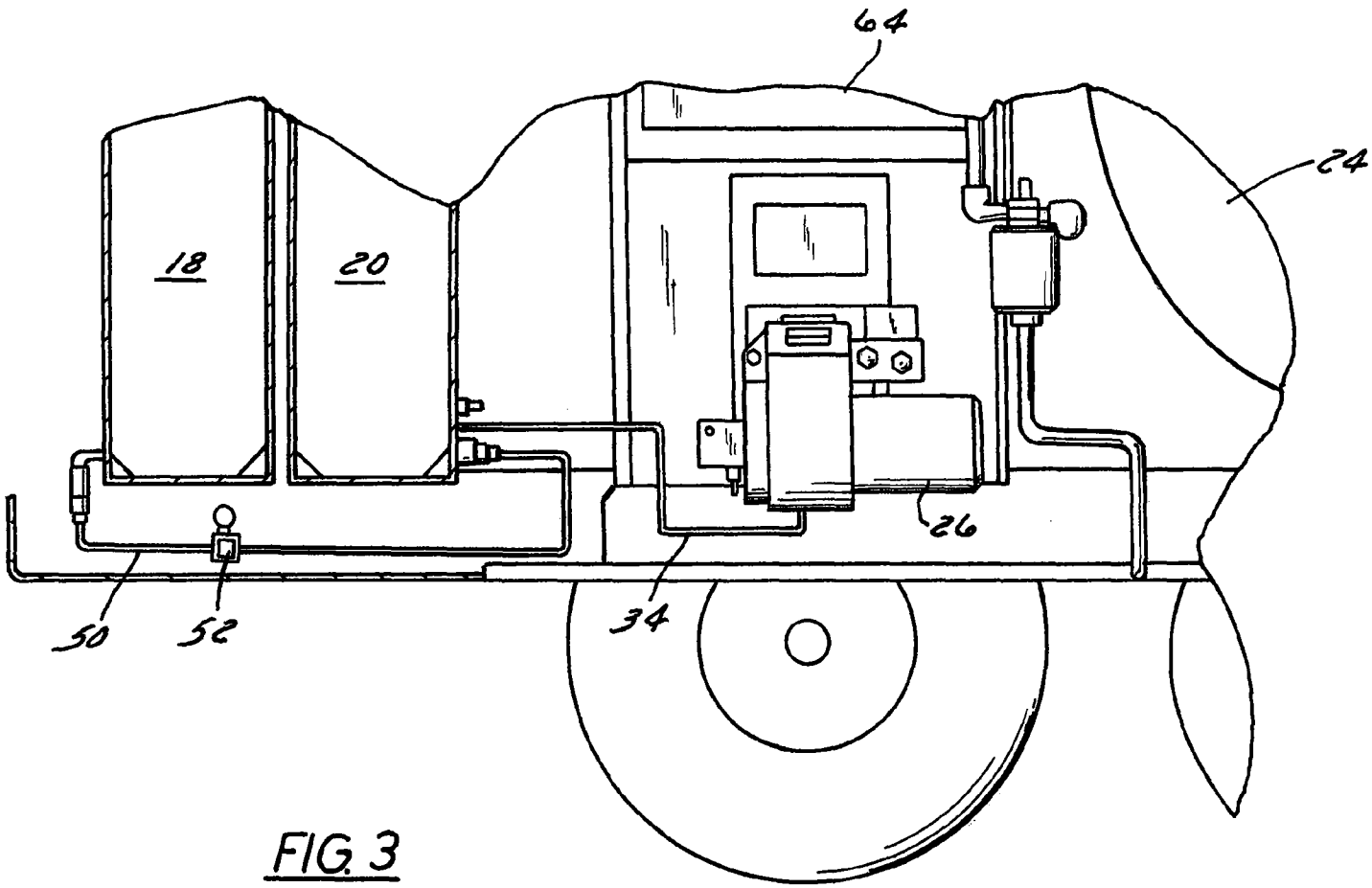
FIG. 3 is a sectional side view of the trailer interior taken along line 3-3 of FIG. 1.

Referring to FIGS. 1-3, the fuel tanks 18 and 20 are shown as being positioned near one another and extending transversely across the trailer 10 adjacent a front wall of the housing 15. However, the fuel tanks 18 and 20 could be separated from one another and located elsewhere within the housing 15 or even outside of the housing 15, such as being strapped beneath a floor 17 of the trailer. In addition, while the surface heater 14 is shown as being mounted on a towed trailer 10, it could be mounted on a truck or other self-propelled vehicle.

In the illustrated embodiment, each of the tanks 18 and 20 preferably has a capacity of about 120 gallons (500 liters), permitting the surface heater 14 to be operated for extended periods of time using the combined volume of fuel from the two tanks 18 and 20. It should be noted that one or more additional tanks could be provided and coupled to the tanks 18 and 20 as discussed below to increase the overall fueling capacity of the tanks and/or to further reduce the volume of fuel stored in any one tank.

Each tank 18 and 20 is filled individually via a dedicated capped fill opening 36, 38 located on top of the tank, but it is conceivable that the fill openings could be coupled to one another by a forked fill tube or that only one of the tanks could have a fill opening, with the other tank being coupled to the one tank by an upper cross-tube or the like.

Figure 4:
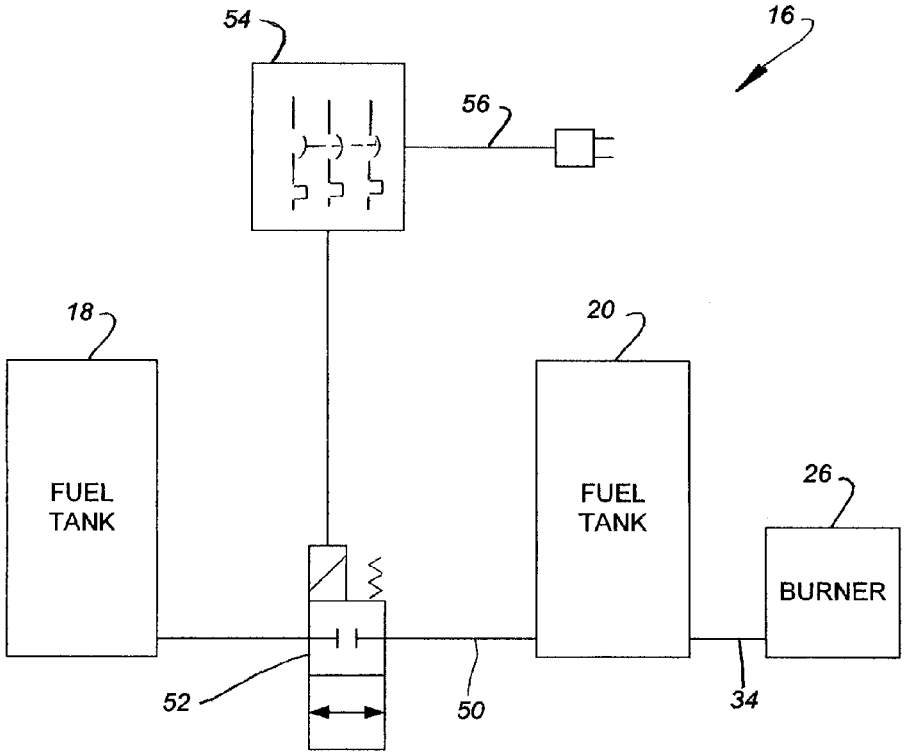
FIG. 4 is a schematic diagram of a the fuel supply system of the surface heater of FIGS. 1-3.

As can be seen in FIG. 3 and the schematic diagram FIG. 4, the first and second fuel tanks 18, 20 are joined by a connection line 50 that originates at or near the bottom of each tank 18, 20. An electronically controlled valve 52 is provided in the connection line 50 for selectively coupling and decoupling the fuel tanks 18 and 20 to and from one another. The valve 52 preferably comprises a two-way, two-position, normally-closed solenoid valve. The solenoid valve 52 is coupled to the machine's electrical system so as to be opened automatically whenever operation of the fueled component, in this case the burner 26, is enabled, thus rendering valve operation invisible to the operator.

In the present example, solenoid valve 52 is connected to the output of the machine's main breaker 54, which is able to be connected by a cable 56 to an external power source such as a mains line or an off-board generator (not shown). If one or more additional fuel tanks were provided, a separate connection line and solenoid valve would be provided for each additional tank and would couple that tank to one of the other tanks in the system in the same manner as connection line 50 and solenoid valve 52.

In use, trailer 10 is towed to the work site via trailer hitch 12. The hoses 32 are unwound from the reels 24 and arranged on the surface to be heated in a desired configuration as is known in the art. The cable 56 is plugged in to the external power source. The solenoid valve 52 remains closed during this transport and set-up, limiting the maximum volume that could be spilled in the event of a fuel tank rupture, fitting failure, etc. to that quantity contained in the affected fuel tank 18 or 20. Once the power source is connected, the user can close main breaker 54 enabling operation of the machine and automatically opening solenoid valve 52. When solenoid valve 52 is open, fuel is accessible from both tanks 18, 20 via connecting line 50 without the need for any sensor or control arrangements, by gravity-fed flow though the connecting line 50 and the valve 52. The fuel tanks 18 and 20 thus effectively act as a combined fuel tank. This assures an equal distribution of fuel between the tanks 18 and 20, improving the machine's weight distribution. It also permits all of the stored fuel to be supplied to the burner 26 via a single supply line 34 coupled to one of the tanks (tank 20 in the embodiment shown), eliminating the need for additional lines and fittings coupling the burner 26 to the other tank.

When the operator is ready to operate the machine 14, he or she manipulates a suitable control to operate a fuel pump (not shown) to supply fuel to the burner 26 from the tanks 18 and 20 via the line 34 to heat the liquid in tank 28. In the present example in which the fuel line 34 is connected to tank 20, fuel flows by gravity into tank 20 from tank 18 through the connecting line 50 and solenoid valve 52 to maintain an even distribution of fuel between the tanks 18 and 20. Pump 30 then circulates heated liquid between the tank and the hoses 32 via a lower supply line 60 and an upper return line 62 to heat the surface on which the hoses 32 are arranged. The pump 30 may be electrically powered and rendered operable by closing of the breaker 54. The upper return line 62 preferably opens into an expansion tank 64 located above the tank 28, as is typical in the art.

With this arrangement, a desired volume of fuel can be transported to and stored at the worksite, and the risk of damage to one of smaller capacity fuel tanks 18, 20 does not pose the same threat in magnitude of spillage as would a single larger capacity tank. Fuel tanks 18, 20 are only connected when the breaker 54 is closed to ready the machine 14 for operation. However, when fueling is required, the fuel tanks 18, 20 are effectively combined so that the burner 26 can by operated for an extended period of time as determined by the consumption rate of the combined volume of fuel in both tanks 18 and 20 despite the fact that the burner 26 is coupled to only the tank 20.

Figure 5:
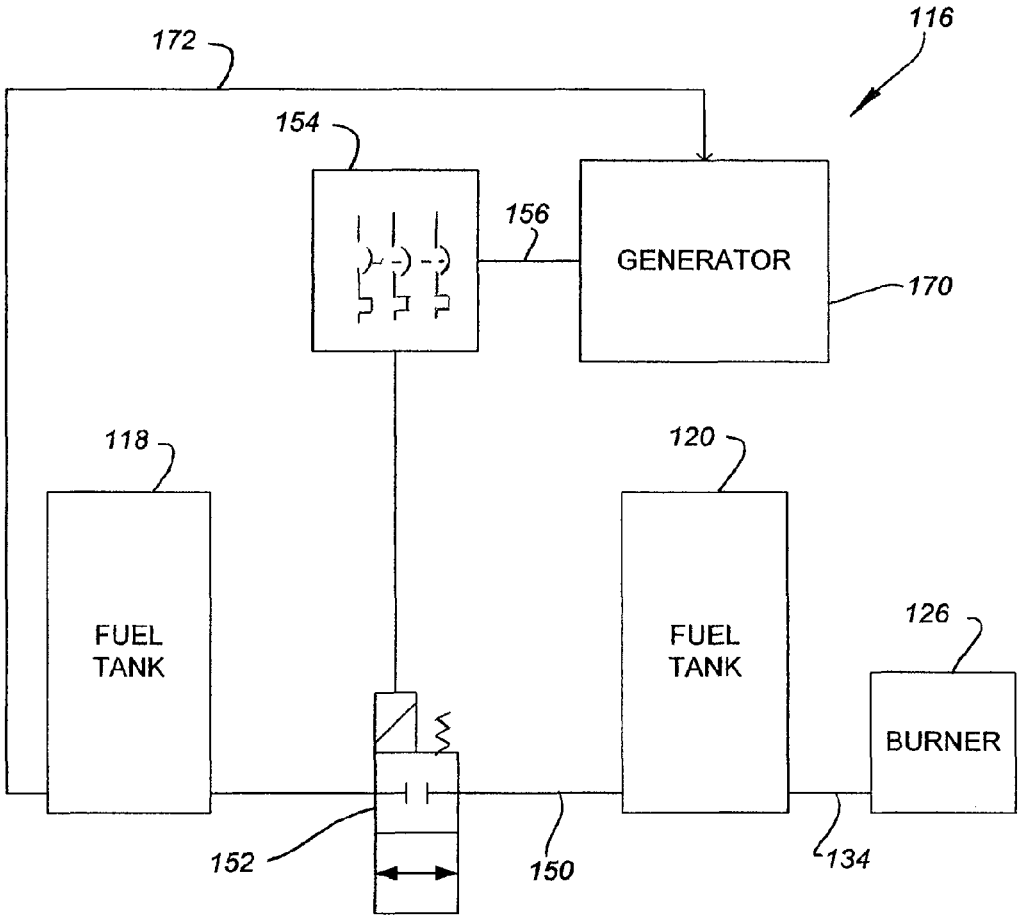
FIG. 5 is a schematic diagram of alternative embodiment of the invention showing the machine powered by an onboard generator rather than an off-board power supply.

Turning now to FIG. 5, relevant portions of a second embodiment of a hydronic surface heater 114 are illustrated. Machine 114 differs from the machine 14 of the first embodiment only in that that the machine 114 has an on-board generator fueled by the same fuel used to power the burner 126. Components of the embodiment of FIG. 5 are designated by the same reference numerals as the corresponding components of FIGS. 1-4, incremented by 100. Hydronic surface heater 114 thus has reels, hoses, pumps, etc. (all of which are omitted for sake of simplicity), in addition to the trailer 110. A burner 126 is powered by a fuel tank system formed from first and second fuel tanks 118, 120. Fuel is supplied to the burner 126 via a supply line 134 coupled to fuel tank 120. As in the first embodiment, the tanks 118 and 120 are connected to one another by a connecting line 150 having a normally-closed, two-way, two-position solenoid valve 152 disposed therein. The solenoid valve 152 is connected to the machine's main breaker 154 so to automatically connect the tanks 118, 120 to one another whenever the breaker 154 is closed in the same manner discussed above in connection with the first embodiment.

Rather than receiving power from an external mains line or other external power source, machine 114 of this embodiment is electrically powered by an on-board generator 170 that is coupled to the breaker 154 by a power cable 156. The generator 170 is fueled by the tanks 118, 120, in this case by being coupled to tank 118 by a supply line 172. While supply line 172 could also be coupled to tank 120, connecting it to tank 118 demonstrates the versatility enabled through the provision of the connecting line 150 and solenoid valve 152. Specifically, separate fueled components are powered by each of the fuel tanks 118 and 120—yet the fuel level within both tanks will remain the same during operation, despite possible uneven fuel consumption rates of the burner 126 and generator 170, due to the gravity-effected leveling made possible through the flow of fuel between the tanks 118, 120 by way of the connecting line 150 and the open solenoid valve 152.

It should also be noted that the embodiment described herein explains the best currently known mode of practicing the invention, and will enable others skilled in the art to utilize the invention, but should not be considered limiting. Rather, it should be understood that the invention is not limited to the details of construction and arrangements of the components as set forth, but is capable of other embodiments and of being practiced or carried out in various ways. For instance, as discussed above, the fuel supply system could include more than two fuel tanks. In addition, the line(s) or other fuel flow path(s) interconnecting the two (or more) tanks could include more than one valve. For example, a separate valve could be provided in or near each end of the connecting line where the line opens into the associated tank, preventing any tank from leaking in the event of connecting line failure. Both valves would be controlled as discussed above in connection with the valve 52. These and all other such modifications and variations are within the scope of the claims set forth below. Further, various elements or features discussed or shown herein may be combined in ways other than those specifically mentioned, and all such combinations are likewise within the scope of the invention.

We claim:

1. A surface heater comprising:

a wheeled carrier adapted to be movable over a surface; and a machine supported on the carrier, the machine including a breaker controlling the supply of electrical power to at least a portion of the machine from a power source, a burner, and a fuel tank system that supplies fuel to the burner, the fuel supply system including first and second fuel tanks;

a connecting line interconnecting the first and second fuel tanks at or adjacent bottoms thereof, and a solenoid valve disposed in the connecting line, the solenoid valve being opened automatically when the breaker is closed and being open whenever the breaker is open.

2. The surface heater of claim 1, wherein the surface heater is a hydronic surface heater.

3. The surface heater of claim 1, further comprising an on-board generator that receives fuel from the fuel supply system.

* * * * *